United States Patent [19]

Yamagishi et al.

[11] Patent Number: 4,961,361

[45] Date of Patent: Oct. 9, 1990

[54] TUNING PIN

[75] Inventors: Fujio Yamagishi, Iwata; Hirohiko Miura, Hamamatsu, both of Japan

[73] Assignee: Kabushiki, Kaisha Kawa, Gakki Seisakusho, Hamamatsu, Japan

[21] Appl. No.: 305,426

[22] Filed: Feb. 1, 1989

[30] Foreign Application Priority Data

Feb. 2, 1988 [JP] Japan ..... 63-12894[U]

[51] Int. Cl.[5] ..... G10C 3/10

[52] U.S. Cl. ..... 84/201; 84/305; 411/418

[58] Field of Search ..... 84/200–208, 84/304, 305; 411/411, 415, 418

[56] References Cited

U.S. PATENT DOCUMENTS

| | | | |
|---|---|---|---|
| 106,145 | 8/1870 | Farnsworth | 84/202 |
| 146,023 | 12/1873 | Russell | 411/415 |
| 3,424,047 | 1/1969 | Whited | 84/202 |
| 3,481,380 | 12/1969 | Breed | 411/415 X |

FOREIGN PATENT DOCUMENTS

| | | | |
|---|---|---|---|
| 2029632 | 1/1971 | Fed. Rep. of Germany | 84/201 |
| 1482415 | 4/1967 | France | 411/411 |
| 598834 | 2/1948 | United Kingdom | 411/411 |

*Primary Examiner*—Brian W. Brown

*Attorney, Agent, or Firm*—Michael N. Meller

[57] ABSTRACT

A tuning pin having a threaded portion is provided with grooves formed in the direction substantially perpendicular to a screw winding direction of the threaded portion. In accordance with another embodiment, the pitch of the screw threads varies on at least part of the threaded portion.

4 Claims, 3 Drawing Sheets

TUNING PIN

FIELD OF THE INVENTION

This invention relates to an improvement of a tuning pin for a string musical instrument such as a piano in which a string of the instrument is held in place by the tuning pin and the tension of the string is adjusted for achieving a desired musical pitch.

BACKGROUND OF THE INVENTION

A string used in a string musical instrument such as a piano is, as shown in FIG. 8, fastened at one end thereof to a hitch pin (not shown) provided on a frame 7 while the other end thereof is wound onto a tuning pin 1 partly screwed into a pin board 8. This tuning pin 1 holds a string 9 set in place and is finely tuned to increase or decrease tension of the string 9 for adjustment of the musical sound pitch of the string. Reference numeral 10 denotes a string depresser.

To accomplish the above purposes, the conventional system has, as shown in FIG. 9, a tuning pin 1 made of a carbon steel cylinder measuring about 7 mm in diameter and 60 mm in length. The tuning pin 1 is machined to form thereon a threaded portion 2 measuring about 35 mm long while a head portion 3 of the tuning pin 1 is formed to have a rectangular section for cooperating with a tuning hammer, which is a tool used to turn the pin. The head portion is provided with a string hole 4 into which the string 9 can be inserted.

The tuning pin 1D of this type in which the threads are cut by machining has, as shown in FIG. 10, a number of scale-shaped machining specks 11 on the surface of the threaded portion 1, each speck being several microns in size. These machining specks 11 serve to provide adequate friction between the tuning pin 1 and the pin board 8, thus enabling a delicate fine tuning of the string to be obtained. However, tuning pin 1D having such specks is manufactured through complicated steps which inevitably result in a higher cost.

On the other hand, threaded portion 2 of a tuning pin 1E can be formed by a roll threading process, as proposed by others and as shown in FIG. 11. Such a tuning pin 1E can be manufactured at low cost. However, compared with tuning pin 1D, which has the threaded portion 2 formed by machining, the threaded portion of tuning pin 1E has a smoother surface, so that when the tuning pin 1E is turned for tuning of the string, slipping between the pin board 8 and the tuning pin 1E causes the pin to race, thus making it difficult to carry out fine adjustment during a tuning operation.

SUMMARY OF THE INVENTION

In order to eliminate the foregoing disadvantages, the present invention provides a tuning pin which is characterized in that the threaded portion 2 of the tuning pin 1 has grooves 5 formed in the direction substantially perpendicular to the screw winding direction. Grooves 5 are irregular in width or formed in the shape of a notch 6, or a pitch P for threads 2A is varied over all or part of the threaded portion 2 or the grooves 5 are further provided in the threaded portion 2 having the varied pitches P for the threads 2A.

Arranged as described in the foregoing, the threaded portion 2 of the tuning pin 1 according to the present invention has an appropriate surface roughness that cannot be obtained with the conventional tuning pin 1D or 1E whose threaded portion is formed by a conventional machining or roll threading process. This enables the maximum static torque of the tuning pin 1 screwed partly into the pin board 8 to be set at a level close to the dynamic torque, so that when performing tuning of a string, the tuning pin 1 can be finely turned without racing, thereby facilitating a finely adjusted tuning.

DETAILED DESCRIPTION OF PREFERRED EMBODIMENTS

Figure 1:
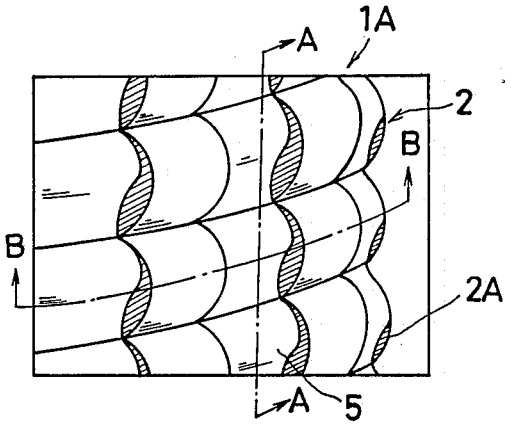
FIGS. 1 through 7 show various preferred embodiments of a tuning pin according to the present invention.

Referring to the drawings, the present invention will now be described in the following.

Figure 2:
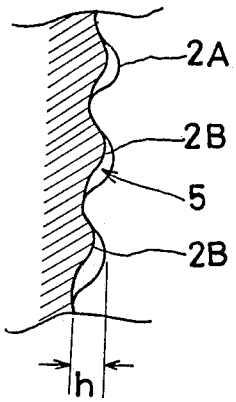
Figure 3:
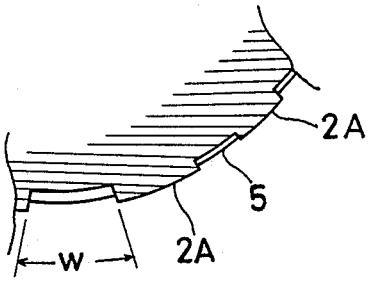

FIG. 1 shows an enlarged view of the threaded portion according to the first preferred embodiment of this invention. The tuning pin 1A is, as specified in the Japan Industrial Standards, made of a carbon steel cylinder measuring about 7 mm in diameter and 60 mm in length and provided with a threaded portion 2 measuring about 35 mm long. This threaded portion 2 is threaded by a roll threading process and is further provided with grooves 5 so formed during the above threading process as to be substantially perpendicular to the winding direction of the pin. As shown in FIG. 2, a screw thread 2B which has a smaller height than the height h of a screw thread 2A is provided in groove 5, whose width is about 0.5 mm. Alternatively, as shown in FIG. 3, some of the grooves 5 have a narrower groove width W. The grooves are disposed one per millimeter.

In other words, the screw threads 2A of the threaded portion 2 of the tuning pin 1A are crushed intermittently in the winding direction thereof to form the grooves 5.

Figure 4:
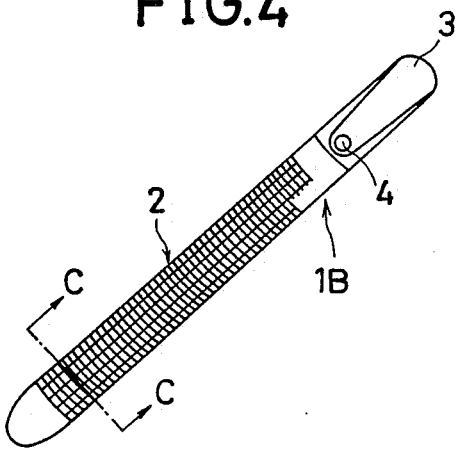
Figure 5:
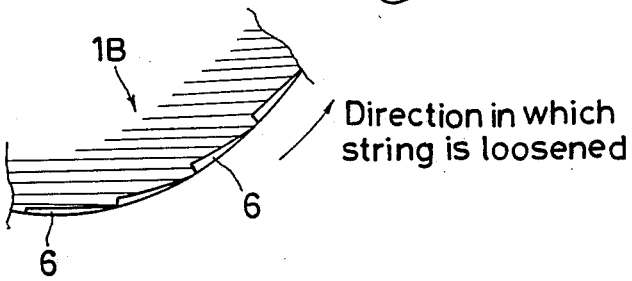

FIG. 4 shows a tuning pin 1B according to the second preferred embodiment of the present invention and FIG. 5 shows a sectional view taken along the line C—C in FIG. 4. This tuning pin 1B has an approximately 35-mm-long threaded portion provided on a tuning pin 1 made to the above-specified size. This threaded portion 2 is threaded by a roll threading process and is provided with notches 6 formed during the roll threading process in the unwinding direction of the tuning pin 1B, that is, the direction in which the tuning pin 1B is unwound to loosen tension of the string 9. The notches 6 are provided in the whole region from the top to the bottom of the threaded portion 2 or in a part thereof, and correspond to the scale-shaped machining specks 11 (several microns in size) formed on the surface of the threaded portion 2 when worked on by a convention machining process. In external appearance, these notches 6 formed on the threaded portion 2 in accordance with the second embodiment resemble streaks.

Figure 6:
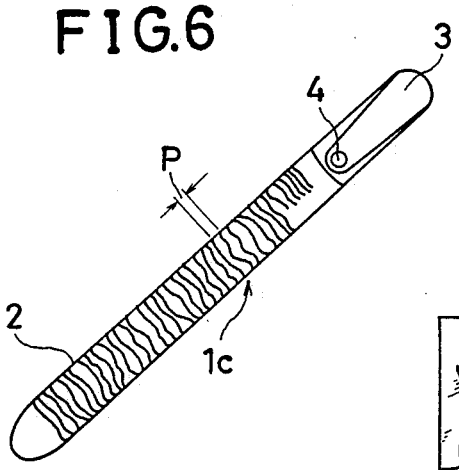

FIG. 6 shows a tuning pin 1C according to the third preferred embodiment of the present invention. This tuning pin 1C also has an approximately 35-mm-long threaded portion 2 provided on a tuning pin 1 made to the above-specified size. The threaded portion 2 has a pitch P for screw threads 2A continuously varied in the whole region thereof from top to bottom.

Figure 7:
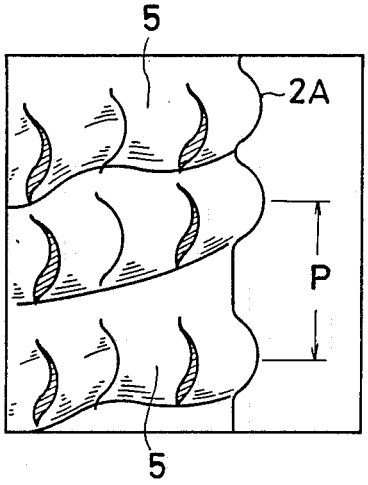
Figure 8:
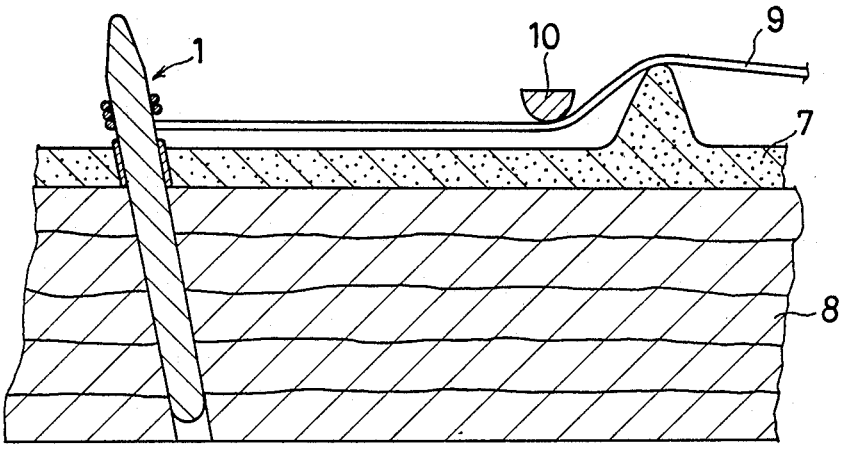
FIG. 8 shows a piano string set in a stretched state.
Figure 9:
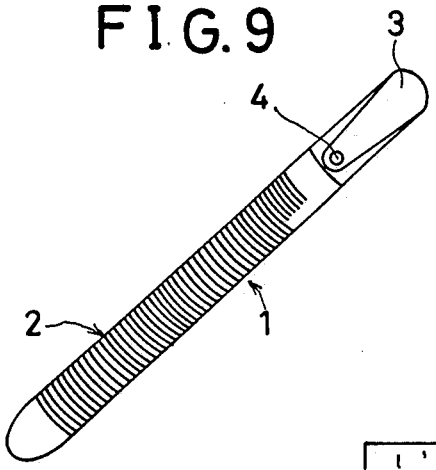
FIG. 9 shows a shape of a tuning pin.
Figure 10:
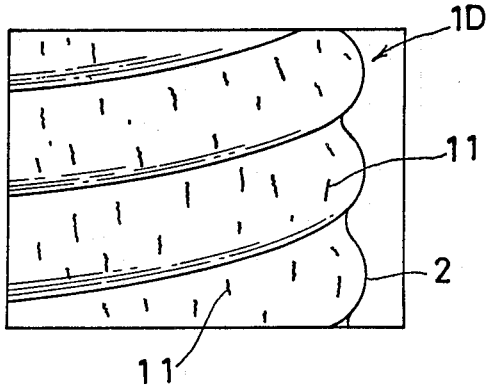
FIGS. 10 and 11 show conventional examples of a tuning pin.
Figure 11:
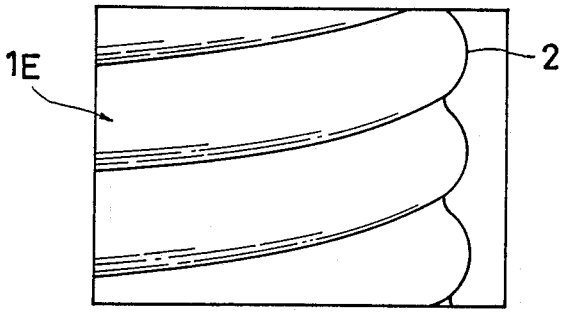

Even when grooves 5 formed in the direction perpendicular to the screw winding direction are provided on the threaded portion 2 of tuning pin 1C, as shown in FIG. 7, the same effect as in the foregoing can be obtained.

In the first through third embodiments of the invention, a head portion 3 of the tuning pin 1 is formed to have a rectangular section for cooperating with a tuning hammer. The head portion 3 is further provided with a string hole 4 into which a string 9 can be inserted.

As described in the foregoing, according to the present invention, the threaded portion of the tuning pin is provided with an appropriate surface roughness which makes the tuning pin engage the pin board in the desired manner.

Thus, the invention can eliminate the disadvantage which attends a conventional tuning pin whereby an undesirable racing occurs due to slipping between the tuning pin and the pin board when tuning is performed. Thus the invention enables the tuning pin to be turned finely through a delicate feel of one's hand so as to facilitate the most delicately and finely adjusted tuning.

In addition, since the threaded portion is formed by applying a roll threading process according to the invention, the high-performance tuning pin as described in the foregoing can be provided at a lower cost, which is another advantage of the present invention.

What is claimed is:

1. A tuning pin for a stringed musical instrument such as a piano, comprising a unitary nonexpandable pin with an external threaded portion having screw threads, each of said threads being provided with grooves formed in a direction substantially perpendicular to a screw winding direction of said threaded portion wherein said grooves are arranged so that the width of one groove is different from the width of another groove.

2. The tuning pin as set forth in claim 1, wherein said grooves are formed in the shape of a notch.

3. A tuning pin as set forth in claim 1 wherein said threaded portion has screw threads, a pitch of said screw threads continuously varying on at least part of said threaded portion.

4. A tuning pin as claimed in claim 1 wherein each of said grooves has a depth substantially equal to the height of the threads of said threaded portions.

* * * * *

UNITED STATES PATENT AND TRADEMARK OFFICE

CERTIFICATE OF CORRECTION

PATENT NO. : 4,961,361

DATED : October 9, 1990

INVENTOR(S) : Yamagishi et al.

It is certified that error appears in the above-identified patent and that said Letters Patent is hereby corrected as shown below:

Title Page, left column;
Amend item (73) to read:
-- (73) KABUSHIKI KAISHA KAWAI GAKKI
SEISAKUSHO, HAMAMATSU, JAPAN --

Signed and Sealed this

Twenty-seventh Day of October, 1992

*Attest:*

DOUGLAS B. COMER

*Attesting Officer*

*Acting Commissioner of Patents and Trademarks*